US007954775B2

(12) United States Patent
Smith et al.

(10) Patent No.: US 7,954,775 B2
(45) Date of Patent: Jun. 7, 2011

(54) ADJUSTABLE SUPPORT ASSEMBLY

(75) Inventors: Todd Smith, Fergus Fall, MN (US); Lindsay Horgen, Fergus Fall, MN (US)

(73) Assignee: Shoremaster, Inc., Fergus Falls, MN (US)

( * ) Notice: Subject to any disclaimer, the term of this patent is extended or adjusted under 35 U.S.C. 154(b) by 789 days.

(21) Appl. No.: 11/975,125

(22) Filed: Oct. 16, 2007

(65) Prior Publication Data

US 2009/0095852 A1 Apr. 16, 2009

(51) Int. Cl.
*F16M 11/20* (2006.01)

(52) U.S. Cl. ..... 248/188.1; 248/235; 248/188.4

(58) Field of Classification Search ..... 248/188.1, 248/295.11, 235, 159, 158, 413, 125.8, 188.4, 248/354.1, 354.4, 354.3, 354.6, 354.5; 405/218; 52/263; 182/62.5, 128, 222, 230, 178.1
See application file for complete search history.

(56) References Cited

U.S. PATENT DOCUMENTS 4,901,971 A * 2/1990 Connelly ..... 248/523
5,848,502 A * 12/1998 Schaefer ..... 52/165
6,343,568 B1 * 2/2002 McClasky ..... 119/428
7,637,275 B2 * 12/2009 Stehly et al. ..... 135/139

* cited by examiner

*Primary Examiner* — Anita M King
(74) *Attorney, Agent, or Firm* — Thorpe North & Western LLP

(57) ABSTRACT

A support structure is disclosed comprising a longitudinally extending hollow member configured to receive a support tube therein. The longitudinally extending hollow member comprises an approximately flat surface opposite an internal corner of the longitudinally extending hollow member. The invention further comprises a support tube configured to be removably inserted within the longitudinally extending hollow member and a mechanism for forcing an outer corner of the support tube into the internal corner of the longitudinally extending member.

21 Claims, 3 Drawing Sheets

ADJUSTABLE SUPPORT ASSEMBLY

BACKGROUND

1. Field

The present invention relates generally to support assemblies. More particularly, the present invention relates to an adjustable platform support structure such as a dock structure.

2. State of the Art

Over the years, various arrangements have been produced to support platform assemblies. For example, a tube and sleeve configuration have been used to connect upper platform surfaces to support legs for a variety of support platforms. However, often the tube moves within the sleeve thereby creating a safety hazard, particularly where adjustability of the leg with respect to the structure is desired. For example, a square hollow member secured to the structure may form a sleeve to slidably receive a square support tube therein forming a support leg for the structure. When the leg is slid to a desired position in the sleeve, a set screw or bolt extending through one side of the square hollow sleeve member is tightened against the adjacent side of the square support leg received in the sleeve to press the received square support leg against the opposite side of the sleeve to hold the square support leg in desired position in the hollow receiving sleeve member. The screw has to be tightened sufficiently to secure the leg in desired position, however, the play required to allow the leg to slide in the sleeve for adjustment purposes makes it difficult to securely hold the leg. If the tube and sleeve are sufficiently fitted together to prevent movement, the support platform is not easily constructed nor easily adjusted. Further, for initial positioning of the leg in the sleeve during construction of the platform and for later adjustment of the position of the leg in the sleeve, there is generally large area sliding contact as sides of the leg slide against sides of the receiving sleeve. The resulting friction, particularly if the sleeve and/or the leg is made of aluminum or aluminum alloy, can make sliding adjustment difficult.

SUMMARY OF THE INVENTION

According to the invention, a support assembly that provides a stable support structure while remaining easily constructible and/or adjustable includes a hollow member or sleeve having an internal corner therein and configured to receive a support tube or leg therein. A support tube or leg is configured to be slidably inserted within the hollow member and a mechanism is provided for forcing an outer corner of the support tube into the internal corner of the hollow receiving member. In this way the leg is tightened against the internal corner and two sides of the sleeve, rather than against only one side of the sleeve. This provides a much more secure connection between the leg and the sleeve while still allowing sufficient play of the leg, when loosened, in the sleeve for easy construction of the structure and adjustment of the leg. In addition, if desired, the sides of the sleeve or the leg can be provided with elongate projections which reduce the surface areas in contact between the sleeve and the leg to reduce resistance to sliding of the leg in the sleeve to therefore make initial assembly and later adjustment of the leg with respect to the sleeve easier, particularly when the leg and/or sleeve are made of aluminum or aluminum alloy. It has been found that the normal square receiving sleeve and normal square leg can be modified by flattening one corner of the square to form a small fifth side of both the sleeve and leg which is opposite one of the corners of the square. By placing a set screw or other tightening mechanism in this fifth side of the sleeve to press against the fifth side of the leg, the leg can be pressed into the corner of the sleeve opposite the fifth side of the sleeve. This provides a much better securement of the leg in the sleeve than can be achieved with the square sleeve and square leg received therein and tightening the square leg against one side of the square sleeve.

In one embodiment, the invention comprises a support structure comprising a longitudinally extending hollow member configured to receive a support tube therein. The longitudinally extending hollow member comprises an approximately flat surface opposite an internal corner of the longitudinally extending hollow member. The invention further comprises a support tube configured to be removably inserted within the longitudinally extending hollow member and a mechanism for forcing an outer corner of the support tube into the internal corner of the longitudinally extending member. In another embodiment of the present invention, the inner surface of the longitudinally extending hollow member further comprises a plurality of longitudinally extending raised surfaces.

In one embodiment of the present invention, the mechanism comprises a threaded aperture in the approximately flat surface of the longitudinally extending member and a threaded bolt configured to mate with the threaded aperture. In yet another embodiment, the mechanism comprises a retractable pin biased in an extended position. In one embodiment of the invention, the longitudinally extending member and support tube are pentagonal. In yet another embodiment, the longitudinally extending hollow member and the support tube comprise aluminum or an aluminum alloy.

In one embodiment of the invention, the direction of the force created by the mechanism is approximately perpendicular to the longitudinal axis of the longitudinally extending hollow member.

In one embodiment, the present invention comprises a load-bearing support structure comprising a five-side longitudinally extending hollow member configured to receive a five-sided support tube therein, wherein the five-sided longitudinally extending hollow member comprises an approximately flat surface opposite an internal corner of the five-sided longitudinally extending hollow member. The invention further comprises a five-sided support tube configured to be removably inserted within the five-sided longitudinally extending hollow member and a mechanism for inducing a moment force approximately perpendicular to the longitudinal axis of the five-sided longitudinally extending hollow member upon the five-sided support tube forcing an outer corner of the five-sided support tube into the internal corner of the five-sided longitudinally extending hollow member.

In one embodiment of the present invention the five-sided longitudinally extending hollow member and five-sided support tube are used to provide structural support to a dock system. The support structure can further include a five-sided pedestal for receiving a bottom end of the five-sided support tube and a five-sided pocket for receiving a top end of the five-sided support tube. In one embodiment, the five-sided pocket is coupled to a dock frame. In yet another embodiment, the dock frame is configured to receive removable panels thereon.

In one embodiment, at least one secondary support member is coupled to the five-sided longitudinally extending hollow member and the dock frame. In yet another embodiment, the load-bearing support structure further comprises a five-sided bracket for receiving a top portion of the five-sided support tube and a locking device for securing the five-sided support tube within the five-sided bracket.

In another embodiment, the present invention comprises a platform support assembly comprising a five-sided longitudinally extending hollow member having an approximately flat surface opposite an internal corner of the five-sided support tube. The internal surface of the five-sided longitudinally extending hollow member comprises a plurality of longitudinally extending raised surfaces extending approximately the entire longitudinal length of the five-sided longitudinally extending hollow member. The platform support assembly further comprises a five-sided support tube having an approximately flat surface opposite an internal corner of the five-sided support tube, the five-sided support tube being configured to be removably inserted within the five-sided longitudinally extending hollow member. The platform assembly further comprises a mechanism for inducing a moment force approximately perpendicular to the longitudinal axis of the five-sided longitudinally extending hollow member upon the five-sided support tube forcing an outer corner of the five-sided support tube into the internal corner of the five-sided longitudinally extending hollow member.

In an additional embodiment, the mechanism for inducing a moment force is configured to allow manual control of the magnitude of the moment force.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Figure 1:
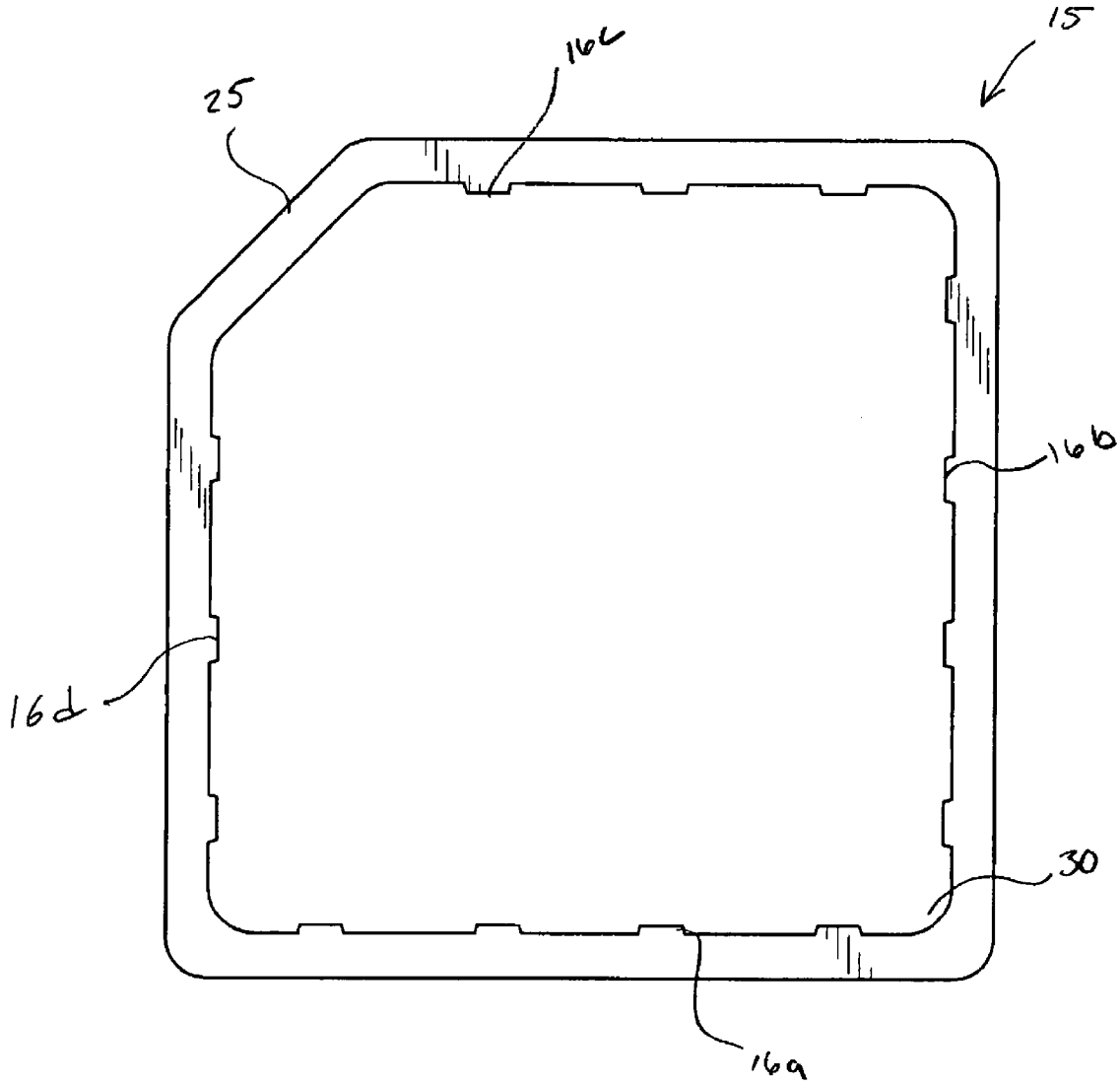
FIG. 1 is a top view of a longitudinally extending hollow member according to one embodiment of the present invention.
Figure 2:
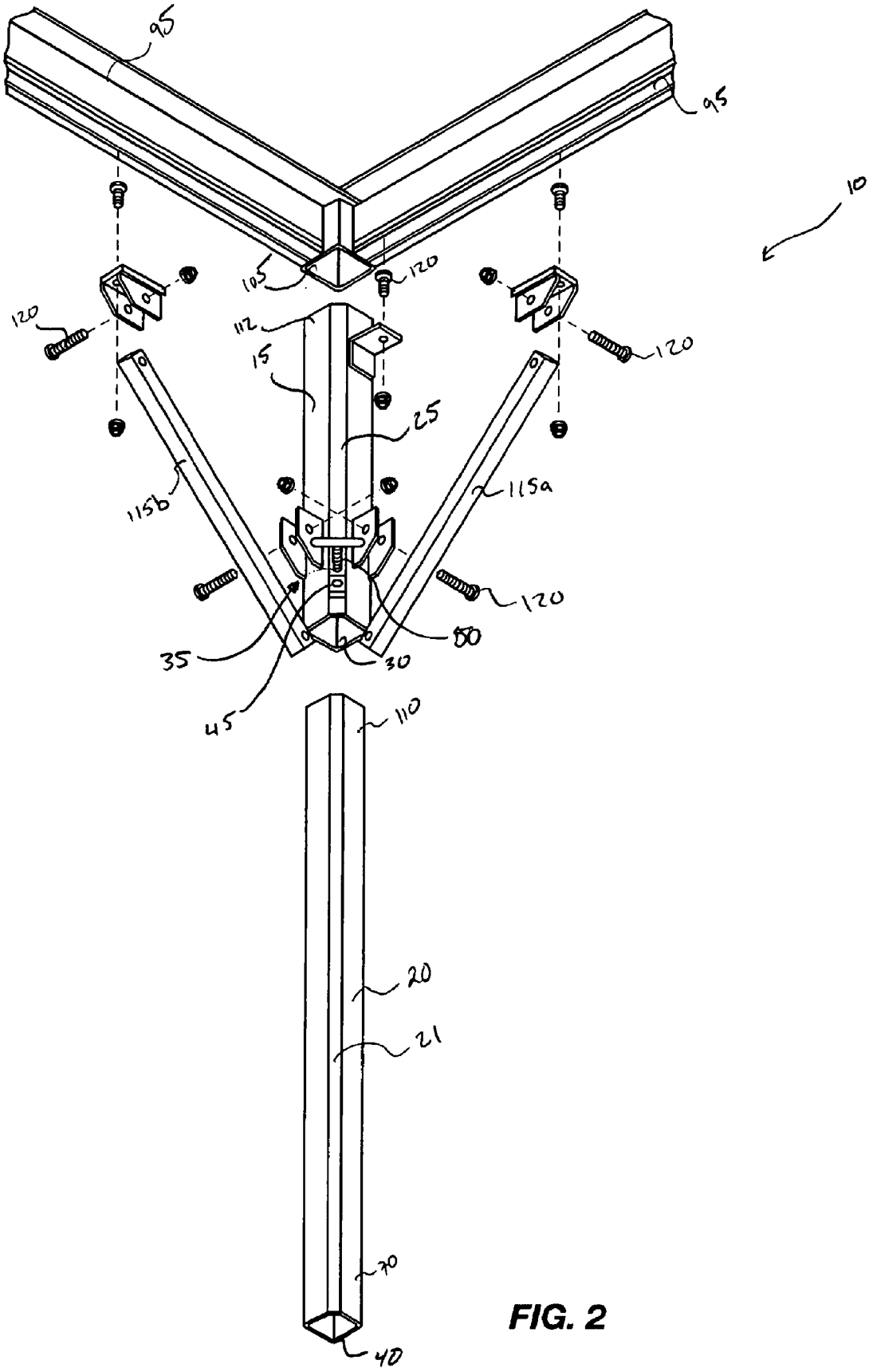
FIG. 2 is perspective view of a support structure according to one embodiment of the present invention.

As illustrated in FIGS. 1 and 2, a support system, indicated generally at 10, in an example implementation in accordance with the invention comprises a longitudinally extending hollow member 15 configured to receive a support tube 20 therein, the longitudinally extending hollow member 15 comprising an approximately flat surface 25 opposite an internal corner 30 of the longitudinally extending hollow member 15. The support tube 20 is configured to be removably inserted within the longitudinally extending hollow member 15 and a mechanism 35, FIG. 2, for forcing an outer corner 40 of the support tube 20 into the internal corner 30 of the longitudinally extending member 15 is provided. The support tube 20 has a flat surface 21 corresponding to flat surface 25 of the longitudinally extending hollow member 15. In general, the support system 10 comprises a means for securing support tube 20 within a longitudinally hollow extending member 15 (sometimes referred to as a longitudinally extending hollow member). The support tube 20 may be positioned longitudinally within longitudinally extending hollow member 15 at a desired location and secured into place by mechanism 35.

In an additional embodiment, the longitudinally extending hollow member 15 further comprises a plurality of raised surfaces 16*a*, 16*b*, 16*c*, and 16*d* oriented parallel to the longitudinal axis of the longitudinally extending hollow member 15. The raised surfaces 16*a*, 16*b*, 16*c*, and 16*d* are disposed on an inner surface of longitudinally extending hollow member 15. The raised surfaces 16*a*, 16*b*, 16*c*, and 16*d* provide means for reducing the surface area of the contact surface between support tube 20 and longitudinally extending hollow member 15 thereby reducing the amount of friction encountered during emplacement of the support tube 20 within longitudinally extending hollow member 15. The raised surfaces 16*a*, 16*b*, 16*c*, and 16*d* may extend the entire length of the longitudinally extending hollow member 15 or be strategically placed within the longitudinally extending hollow member 15 at different locations and along different lengths of the longitudinally extending hollow member 15 in order to optimize reduction of the surface area of the contact surface. In another aspect, raised surfaces may be placed on the exterior of support tube 20 in lieu of, or in addition to placement on the interior of longitudinally extending hollow member 15. It is to be understood that a similar configuration may be accomplished by a series of grooves (not shown) disposed on the exterior of longitudinally extending hollow member 15 and/or the interior of support tube 20 so long as the surface area of the contact surface between longitudinally extending hollow member 15 and support tube 20 is reduced.

In one embodiment, the mechanism 35 for forcing an outer corner 40 of the support tube 20 into the internal corner 30 of the longitudinally extending member 15 comprises a threaded aperture 45 in the approximately flat surface 25 of the longitudinally extending member 15 and a threaded bolt 50 configured to mate with the threaded aperture 45. The magnitude of force applied by the mechanism can thereby be controlled manually by the user by tightening or loosening the threaded bolt 50 within threaded aperture 45. In another embodiment, the mechanism 35 for forcing an outer corner 40 of the support tube 20 into the internal corner 30 of the longitudinally extending member 15 comprises a retractable pin (not shown) biased in an extended position. It is to be understood that any mechanism capable of directing a force substantially perpendicular to the longitudinal axis of the support tube 20 thereby forcing an exterior corner 40 of the support tube 20 into an interior corner 30 of longitudinally extending hollow member 15 is contemplated herein. The longitudinally extending hollow member 15 and the support tube 20 can comprise aluminum, an aluminum alloy, or any other suitable material.

Figure 3:
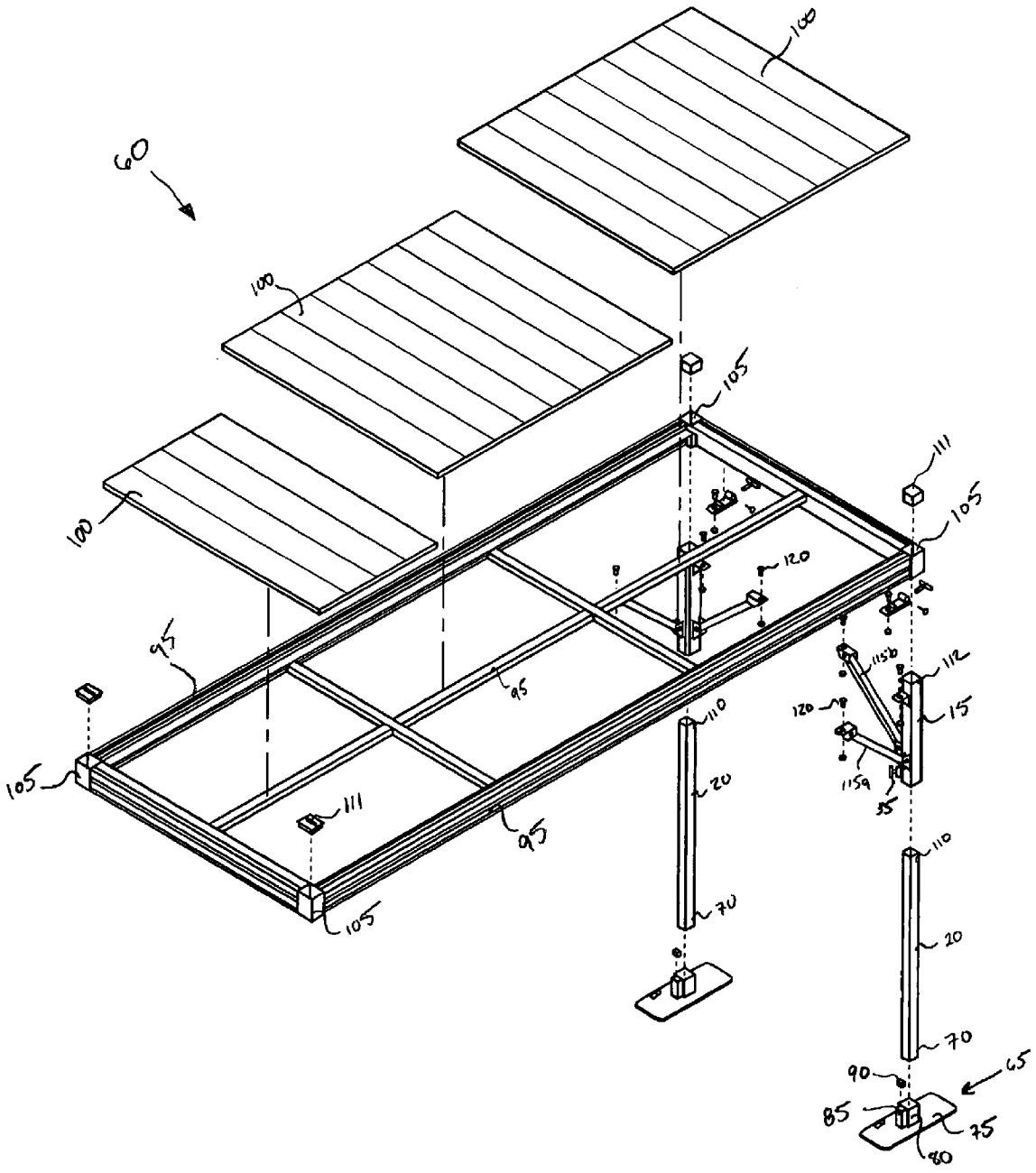
FIG. 3 is a perspective view of platform support assembly according to one embodiment of the present invention.

Referring now to FIGS. 2 and 3, in accordance with another embodiment of the present invention, the support structure 10 comprises a longitudinally extending hollow member 15 configured to receive a support tube 20 therein, the longitudinally extending hollow member 15 comprising an approximately flat surface 25 opposite an internal corner 30 of the longitudinally extending hollow member 15. The support tube 20 is configured to be removably inserted within the longitudinally extending hollow member 15 and a mechanism 35 for forcing an outer corner 40 of the support tube 20 into the internal corner 30 of the longitudinally extending member 15 is provided. In one embodiment, the longitudinally extending hollow member 15 comprises a five-side longitudinally extending hollow member configured to receive a compatible five-sided support tube 20 therein.

In one embodiment, the longitudinally extending hollow member 15 and corresponding support tube 20 are used to provide structural support to a dock system 60. The support structure 10 further comprises a pedestal 65 for receiving a bottom end 70 of the support tube 20. The pedestal comprises a base member 75 with a first receiving member 80 configured to mate with the bottom end 70 of support tube 20. A second receiving member 85 adjacent the receiving member 80 is configured to receive a wedge member 90 therein to secure the bottom end 70 of support tube 20 within first receiving member 80.

The dock system 60 comprises a frame 95 configured to receive and support removable panels 100 thereon. The frame 95 further comprises pockets 105 configured to receive a top end 110 of support tube 20 therein. Caps 111 are provided for covering pockets 105. In one aspect of the invention, pocket 105 further comprises a five-sided bracket (not shown) for receiving at least a top portion 110 of the five-sided support tube 20 and further comprising a locking mechanism (not shown) for securing the five-sided support tube 20 within the five-sided bracket. The locking mechanism may comprise any locking mechanism described herein or suitable for securing the support tube 20 within the five-sided bracket.

In another embodiment, the pockets 105 are configured to receive a top end 112 of the longitudinally extending hollow member 15 therein with the top end 110 of support tube 20 received within both the longitudinally extending hollow member 15 and the support tube 20. In an additional embodiment, the longitudinally extending hollow member 15 is secured to the frame 95 by secondary support members 115*a*, 115*b* coupled to the frame 95 by bolts 120, welding (not shown) secondary support members 115*a*, 155*b* to the frame 95 itself, or secured in some other suitable fashion.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A support structure, comprising:

a longitudinally extending hollow member configured to receive a support tube therein, the longitudinally extending hollow member comprising an approximately flat surface opposite an internal corner of the longitudinally extending hollow member;

a support tube configured to be slidably inserted within the longitudinally extending hollow member; and a mechanism for forcing an outer corner of the support tube into the internal corner of the longitudinally extending hollow member to thereby secure the support tube in a desired position with respect to the longitudinally extending hollow member.

2. The support structure of claim 1, wherein the inner surface of the longitudinally extending hollow member further comprises a plurality of longitudinally extending raised surfaces.

3. The support structure of claim 1, wherein the mechanism for forcing an outer corner of the support tube into the internal corner of the longitudinally extending member comprises a threaded aperture in the approximately flat surface of the longitudinally extending member and a threaded bolt configured to mate with the threaded aperture.

4. The support structure of claim 1, wherein the longitudinally extending member and support tube are pentagonal.

5. The support structure of claim 1, wherein the longitudinally extending hollow member and the support tube comprise aluminum or an aluminum alloy.

6. The support structure of claim 1, wherein the direction of the force created by the mechanism is approximately perpendicular to the longitudinal axis of the longitudinally extending hollow member.

7. A load-bearing support structure, comprising:

a five-side longitudinally extending hollow member configured to receive a five-sided support tube therein, wherein the five-sided longitudinally extending hollow member comprises an approximately flat surface opposite an internal corner of the five-sided longitudinally extending hollow member;

a five-sided support tube configured to be slidably inserted within the five-sided longitudinally extending hollow member; and a mechanism for inducing a moment force approximately perpendicular to the longitudinal axis of the five-sided longitudinally extending hollow member upon the five-sided support tube forcing an outer corner of the five-sided support tube into the internal corner of the five-sided longitudinally extending hollow member to thereby secure the support tube in a desired position with respect to the longitudinally extending member.

8. The load-bearing support structure of claim 7, wherein the five-sided longitudinally extending hollow member and five-sided support tube are used to provide structural support to a dock system.

9. The load-bearing support structure of claim 7, further comprising a five-sided pedestal for receiving a bottom end of the five-sided support tube.

10. The load-bearing support structure of claim 7, further comprising a five-sided pocket for receiving a top end of the five-sided support tube.

11. The load-bearing support structure of claim 10, wherein the five-sided pocket is coupled to a dock frame.

12. The load-bearing support structure of claim 11, wherein the dock frame is configured to receive removable panels thereon.

13. The load-bearing support structure of claim 11, wherein at least one secondary support member is coupled to the five-sided longitudinally extending hollow member and the dock frame.

14. The load-bearing support structure of claim 7, further comprising a five-sided bracket for receiving a top portion of the five-sided support tube and a locking device for securing the five-sided support tube within the five-sided bracket.

15. A platform support assembly, comprising:

a five-sided longitudinally extending hollow member having an approximately flat surface opposite an internal corner of the five-sided longitudinally extending hollow member, wherein the internal surface of the five-sided longitudinally extending hollow member comprises a plurality of longitudinally extending raised surfaces extending approximately the entire longitudinal length of the five-sided longitudinally extending hollow member;

a five-sided support tube having an approximately flat surface opposite an outer corner of the five-sided support tube, the five-sided support tube being configured to be removably inserted within the five-sided longitudinally extending hollow member; and a mechanism for inducing a moment force approximately perpendicular to the longitudinal axis of the five-sided longitudinally extending hollow member upon the five-sided support tube forcing the outer corner of the five-sided support tube into the internal corner of the five-sided longitudinally extending hollow member.

16. The platform support assembly of claim 15, wherein the mechanism for inducing a moment force is configured to allow manual control of the magnitude of the moment force.

17. The platform support assembly of claim 15, further comprising a five-sided pocket for receiving the five-sided longitudinally extending hollow member and the five-sided support tube therein.

18. The platform support assembly of claim 17, further comprising a platform frame coupled to the five-sided pocket.

19. The platform support assembly of claim 17, further comprising a five-sided bracket for receiving at least a top portion of the five-sided support tube and further comprising a locking mechanism for securing the five-sided support tube within the five-sided bracket.

20. A support structure, comprising:

a longitudinally extending hollow member configured to receive a support tube therein, the longitudinally extending hollow member comprising an approximately flat surface opposite an internal corner of the longitudinally extending hollow member;

a support tube configured to be slidably inserted within the longitudinally extending hollow member;

a mechanism for forcing an outer corner of the support tube into the internal corner of the longitudinally extending hollow member to secure the support tube in a desired position with respect to the longitudinally extending hollow member; and longitudinally extending raised surfaces along one of the inner surface of the longitudinally extending hollow member or the outer surface of the support tube to reduce sliding friction between the longitudinally extending hollow member and the support tube during relative sliding movement of the support tube in the longitudinally extending hollow member.

21. The load-bearing support structure of claim 7, further comprising a plurality of longitudinally extending raised surfaces along one of the inner surface of the longitudinally extending member or the outer surface of the support tube to reduce sliding friction between the longitudinally extending member and the support tube during relative sliding movement of the support tube in the longitudinally extending member.

* * * * *